US006089001A

United States Patent [19]

Hurst

[11] Patent Number: 6,089,001

[45] Date of Patent: Jul. 18, 2000

[54] INCLINED TRAY BOTTLE TRAYING MACHINE

[76] Inventor: Richard F. Hurst, Box #21665, Ft. Lauderdale, Fla. 33335

[21] Appl. No.: 09/042,828

[22] Filed: Mar. 17, 1998

[51] Int. Cl.[7] ..... B65B 35/30

[52] U.S. Cl. ..... 53/448; 53/543; 53/390

[58] Field of Search ..... 53/235, 244, 250, 53/253, 147, 543, 544, 443, 446, 448, 48.1, 48.7, 398, 449, 390; 414/276; 198/406

[56] References Cited

U.S. PATENT DOCUMENTS

| | | | |
|---|---|---|---|
| 2,671,568 | 3/1954 | Rundt | 214/7 |
| 3,073,086 | 1/1963 | Martin et al. | 53/398 |
| 3,193,979 | 7/1965 | Dollheimer | 53/449 |
| 3,481,107 | 12/1969 | Andblad et al. | 53/159 |
| 3,968,619 | 7/1976 | Fishburne | 53/449 |
| 4,796,754 | 1/1989 | Chaussadas et al. | 53/398 |
| 4,932,191 | 6/1990 | Wild | 53/543 |
| 5,241,805 | 9/1993 | Johnson | 53/543 |
| 5,287,647 | 2/1994 | Hunter | 53/398 |
| 5,454,211 | 10/1995 | Ziegler et al. | 53/458 |
| 5,618,843 | 4/1997 | Ganz | 53/543 |

FOREIGN PATENT DOCUMENTS

| | | | |
|---|---|---|---|
| 649620 | 3/1979 | U.S.S.R. | 53/543 |

*Primary Examiner*—Ed Tolan
*Attorney, Agent, or Firm*—Richard M. Saccocio P.A.

[57] ABSTRACT

A method and apparatus are provided to sequentially capture the lead bottle from a row of bottles in a multi-pocketed bottle indexing wheel means, and sequentially rotate and push pocketed bottles from said index wheel means to an inclined traying means, automatically collecting said bottles in a gravity compressed hexagonal pattern within said inclined traying means. Inclined traying means includes a means for trayed bottle removal.

8 Claims, 2 Drawing Sheets

INCLINED TRAY BOTTLE TRAYING MACHINE

FIELD OF THE INVENTION

The present invention relates to automatic bottle tray loading machines of the type adapted to collect bottles in storage trays primarily in the pharmaceutical, food and cosmetic industries.

More particularly, the present invention relates to a novel automatic bottle inclined tray loading machine which will collect bottles in a gravity compressed hexagonal pattern within a bottle tray to minimize storage space and lessen damage due to subsequent bottle tray handling.

DESCRIPTION OF PRIOR ART

Prior art including Norquist U.S. Pat. No. 2,698,693 teaches horizontal bottle off loading with orthogonal bottle patterning, in a machine that uses tangential pusher plates to push a row of bottles into a collection area. In similar fashion, International Machinery U.S. Pat. No. 2,909,944 segregates a row of bottles from a conveyor by using a linear tangential force against said bottles in a feed direction perpendicular to said conveyor for horizontal orthogonal bottle collection. Gordon U.S. Pat. No. 3,570,211 and Thornton U.S. Pat. No. 3,618,288 use a similar technology. Green et al U.S. Pat. No. 3,708,947 teaches a horizontal bottle traying machine with a complex tangential bottle row feeding mechanism, however, with hexagonal patterned bottle capability. Smith et al U.S. Pat. No. #5,477,663 teaches a complex pick and place mechanism to select a linear group of bottles from a row of bottles and transfer said linear group of bottles to a tray.

DESCRIPTION OF PRIOR ART, CONT'D

The present invention provides a multi-pocketed indexing wheel means to sequentially capture the lead bottle from a row of bottles, transport individually pocketed bottles to a tangential exit means, and to sequentially exit and push said bottles onto an inclined traying means where bottles are automatically gravitationally compressed into a hexagonal pattern. The present invention provides a tray loader which affords bottle control and stability far in excess of prior art. Additionally, the tray loader of the present invention comprises a vastly simpler machine than that of the prior art, substantially using one moving part—the indexing wheel means—to capture and supply bottles to the passive inclined traying means.

SUMMARY OF THE INVENTION

It is a principle object of the present invention to automatically collect bottles in a gravitationally compressed hexagonal pattern in an inclined traying means.

It is a principle object of the present invention to sequentially capture the lead bottle in a row of bottles within a multi-pocketed indexing wheel means, transport individually pocketed bottles to a tangential exit means, and to sequentially exit and push said bottles onto an inclined traying means.

It is a principle object of the present invention to provide a maximum filled bottle tray to minimally optimize space requirements for tray storage.

It is a principle object of the present invention to provide a maximum filled bottle tray to minimally optimize bottle motion and damage during filled tray handling and storage.

It is a principle object of the present invention to provide a bottle traying means with an open narrow lower single bottle entry end, and a larger elevated bottle exit end.

It is a principle object of the present invention to impart an agitating force to gravitationally compressed trayed bottles as each new bottle enters the open narrow end of the provided bottle traying means.

According to these and other objects of the present invention, there is provided a novel method and apparatus for traying bottles. The method comprises sequentially capturing the lead bottle of a row of forward resilient moving bottles, as provided from any source, in a multi-pocketed indexing wheel means, transporting individually pocketed bottles to an exit means, and to sequentially exit and push said bottles from said exit means to an inclined traying means wherein bottles are gravitationally compressed into a hexagonal pattern for removal and storage.

DESCRIPTION OF THE PREFERRED EMBODIMENTS

Figure 1:
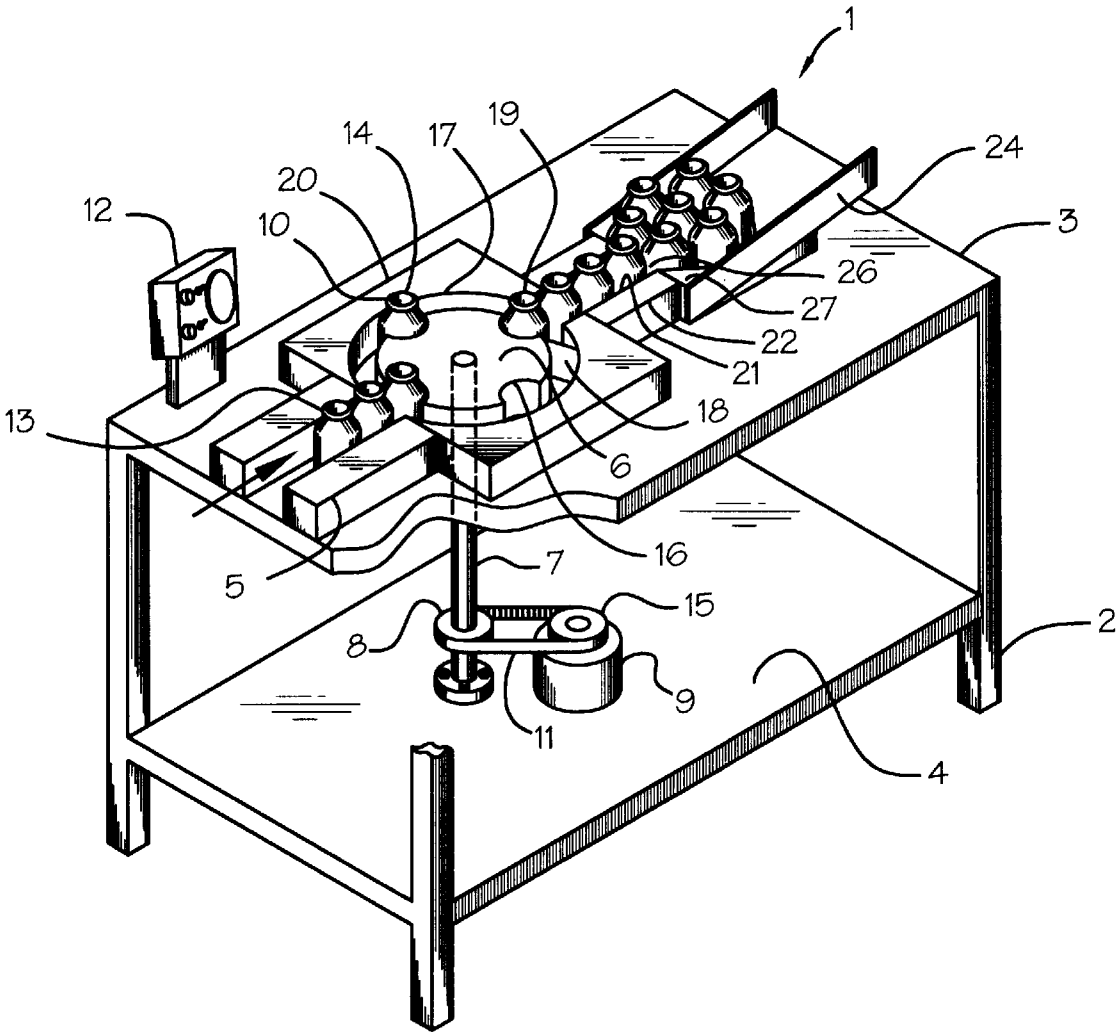
FIG. 1 is an isometric drawing of a preferred embodiment apparatus for feeding bottles from a multi-pocked indexing wheel means to an inclined traying means for collection in a gravitationally compressed hexagonal pattern.

Referring now to FIG. 1 which shows an isometric drawing in schematic form of a preferred embodiment, apparatus for automatically traying bottles in a gravity compressed hexagonal pattern. By a hexagonal pattern, it is meant that the bottles are arranged in a multi row array whereby the bottles in each row are out of registration with the bottles in each succeeding row by a width of one-half of a bottle and such that when viewed from above two adjacent bottles in one row, three adjacent bottles in the next row and two adjacent bottles in the third row form a hexagonal pattern.

Single inclined tray machine 1 includes a main deck 3 and a lower deck 4 supported by a machine frame 2 such as corner legs. Bottle infeed guides 5 receive bottles 10 from an outside source as indicated by the arrow in FIG. 1. Bottle infeed guides 5 serve to align a plurality of bottles 10 in a single column and feed the bottles 10 one at a time to a multi-pocketed index wheel 6. Index wheel 6 comprises a circular member having a plurality of spaced cutouts or pockets 16 within and around the periphery thereof. Index wheel 16 fits within a circumferential guide 20 having a substantially circular opening 17 therewithin.

An electric motor 9 is used to rotate index wheel 6. This may be accomplished using a drive sprocket 15, a belt 11, another sprocket 8, and a shaft 7 which are operatively connected between motor 9 and index wheel 6. A switch box 12 may be used to control the operation of motor 9.

Index wheel 6 includes two active positions, a bottle infeed position 13 and bottle exit position 19. In operation, a plurality of bottles 10 are feed into and aligned within infeed guides 5, the feeding being accomplished by the resilient force of each bottle 10 against each other as they advance within infeed guides 5. The lead bottle is feed into infeed position 13. Rotation of index wheel 6 moves the lead bottle to an intermediate position 14 at which time another bottle 10 is feed into the infeed position 13. Further rotation of index wheel 6 moves the lead bottle 10 to the exit position 19 and the process repeats itself. The circumfrential guide in conjunction with the opening 17 and the cutouts 16 in index wheel 6 retains each bottle 10 within its respective cutout 16 as index wheel 6 rotates. A bottle exiting guide 18 is attached to main deck 3 and arranged relative to index wheel 6 such that when a bottle 10 reaches exit position 19, contact is made with exit guide 18 which forces the bottle 10 out of its cutout 16 and into the entrance to exiting guide 22.

Exiting guide 22 comprises a pair of parallel arranged members having a space comprising a track 21 therebetween which is approximately equal to the width of one bottle 10. As each succeeding bottle 10 exits from index wheel 6, it pushes the previous bottle along the track 21 within exiting guide 22. Upon reaching the end of the track 21 between guides 20, the advancing bottle 10 exits track 21 and enters the tray entrance 26 to inclined tray 24. Continued operation of index wheel 6 causes the feeding of more and more bottles into index wheel 6 and into the inclined tray 24.

As shown in FIG. 1, inclined tray 24 is inclined at an angle relative to the plane of index wheel 6 and main deck 3. Such inclining causes the bottles 10 within inclined tray 24, due to their weight and the natural action of gravity, to form a compressed array of bottles toward the lowermost point of the inclined tray 24, the lowermost point being the entrance 21 to inclined tray 24. The use of delta blocks 27 allows the bottles entering inclined tray 24 to spread out to the sides of tray 24 thus, when an additional bottle is forced into tray 24, it necessarily pushes against the gravitational force of the other bottles in tray 24 causing each bottle to seek a gravity induced patterned position which is thereafter maintained by the force of gravity. The patterned array comprises the above described array where each row of bottles in tray 24 are out of registry with an adjacent row by the width of one half of a bottle and whereby adjacent bottles 10 in three adjacent rows form a hexagonal pattern and whereby the bottles 10 nest within the crevices formed by adjacent bottles in each row. Each bottle 10 entering the inclined tray 24 imparts an upward agitating force relative to the other bottles 10 within tray 24 which due to their weight and the gravitational force compresses the array of bottles 10 into the most compact arrangement possible comprising the out of registry of each row and the nesting of each bottle in the crevice between adjacent bottles in the above and below rows.

From the aforementioned description it will be understood that bottles 10 received from the bottle entry position 13 of index wheel 6 are pushed from the bottle exit position 19, through guides 22 and into the inclined tray 24 where the bottles are automatically compressed by gravity. When inclined tray 24 is filled, the tray is removed and replaced by an empty inclined tray which then becomes filled and the process repeats itself.

Figure 2:
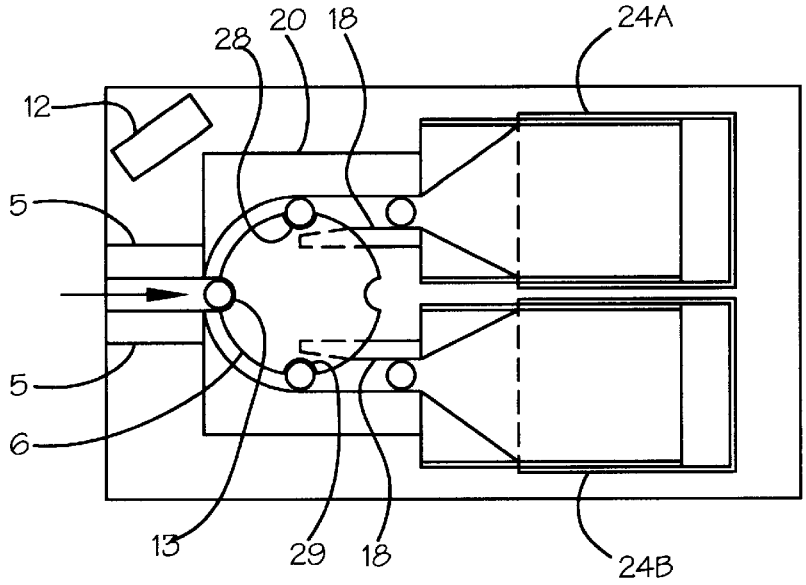
FIG. 2 is a plan overhead view of a preferred embodiment apparatus for feeding bottles from a selectably reversible multi-pocked indexing wheel means into either of two inclined traying means.

In FIG. 2, another embodiment of the present invention is shown. The embodiment of FIG. 2 utilizes two inclined trays 24 in conjunction with a single index wheel 6. In this embodiment, the exit position of index wheel 6 is at the three and nine o'clock positions of index wheel 6. Accordingly, stationary exit guides 18 are positioned at the location of cutouts 28 and 29 in FIG. 2. In this embodiment, index wheel 6 is capable of rotating in a clockwise and a counter clockwise direction. The clockwise direction being used to fill tray 24A; the counter clockwise direction being used to fill tray 24B. Of course, one tray is filled at one time and when filled, the direction of index wheel 6 is reversed to fill the other tray. The filled tray is removed and replaced by an empty tray while the other tray is being filled. Otherwise the embodiment of FIG. 2 is the same as that of FIG. 1.

Figure 3:
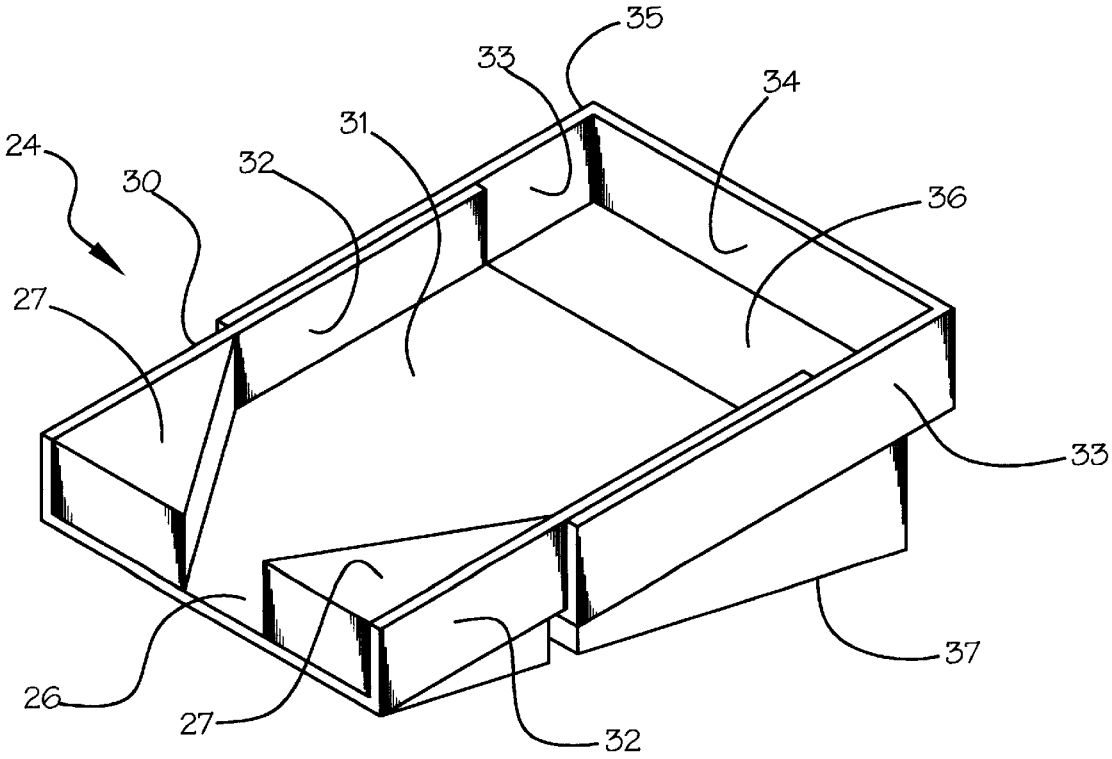
FIG. 3 is an isometric drawing of a preferred embodiment inclined traying means with a cooperating telescoping transfer removable tray means.

FIG. 3 depicts the unique tray 24 used in the two embodiments discussed above. Inside member 30 includes a bottom 31, sides 32 and delta blocks 27. The opening 26 between delta blocks 27 provide for the entrance of bottles 10 into inclined tray 24. Outside member 35 includes a back 34, sides 33 and a bottom 36. The distance between sides 33 is slightly more than the distance between sides 32 such that outside member 35 can telescope relative to inside member 30 and vice versa. Inclined member 37 may or may not be fixedly attached to outside member 35. The advantage provided by the telescopic action of members 30 and 35 is that upon inside member being filled with bottles 10, the bottles 10 may be transferred to outside member 35 for subsequent operations.

What is claimed is:

1. A method for loading bottles into a tray comprising the steps of:

feeding a plurality of bottles, on a one-by-one basis, into an index wheel containing one or more cutouts;

rotating said index wheel from a bottle infeed position to a bottle exiting position;

removing each bottle at said exiting position by a bottle exiting guide;

arranging said bottles exiting from said index wheel into a straight line;

infeeding said exiting bottles arranged in a straight line into a rectangular tray by a force of each bottle pushing against a preceding bottle; and, using the force of gravity by inclining said tray such that the force of gravity in conjunction with the pushing force of each bottle, arranges the bottles in the rectangular tray into rows which are out of registry with each other by a width of one half of one bottle.

2. The method of claim 1 including the step of transferring the bottles in said inclined tray into another tray which is arranged in a telescoping relationship with said inclined tray.

3. The method of claim 1 including the step of transferring said bottles to a second inclined tray when said inclined tray is filled.

4. The method of claim 3 including the step of transferring said bottles in said second inclined tray into another tray which is arranged in a telescoping relationship with said second inclined tray when said second inclined tray is filled.

5. Apparatus for loading bottles into a tray comprising, a rotatable index wheel having one or more cutouts around the periphery thereof, feeding apparatus arranged upstream of said index wheel for positioning a leading bottle into said one or more cutouts in said index wheel, exit apparatus arranged downstream of said index wheel for removing said lead bottle from said index wheel and , an inclined rectangular tray positioned downstream of said exit apparatus, said inclined tray receiving said leading bottle and successive bottles thereafter, said bottles being arranged in said tray in contacting rows with each row being offset from an adjacent row by the width of one half of a bottle.

6. The apparatus of claim 5, including a second exit apparatus and a second inclined rectangular tray positioned at a second exit position of said index wheel, said index wheel being rotatable in a first direction toward said first inclined rectangular tray and in a second direction toward said second inclined rectangular tray.

7. The apparatus of claim 5 wherein said inclined tray includes a first tray portion having an open back and a second tray portion having an open front, said tray portions being telescopingly arranged to each other.

8. The apparatus of claim 6 wherein said second inclined tray includes a first tray portion having an open back and a second tray portion having an open front, said tray portions being telescopingly arranged to each other.

* * * * *